US011130338B2

(12) United States Patent
Matsufuji et al.

(10) Patent No.: US 11,130,338 B2
(45) Date of Patent: Sep. 28, 2021

(54) LIQUID DISCHARGE HEAD AND LIQUID DISCHARGE APPARATUS

(71) Applicants: Ryohta Matsufuji, Kanagawa (JP); Kohta Akiyama, Kanagawa (JP); Noriyasu Takeuchi, Kanagawa (JP)

(72) Inventors: Ryohta Matsufuji, Kanagawa (JP); Kohta Akiyama, Kanagawa (JP); Noriyasu Takeuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 69 days.

(21) Appl. No.: 16/677,567

(22) Filed: Nov. 7, 2019

(65) Prior Publication Data

US 2020/0171828 A1 Jun. 4, 2020

(30) Foreign Application Priority Data

Nov. 29, 2018 (JP) ..... JP2018-223340

(51) Int. Cl.
*B41J 2/16* (2006.01)
*B41J 2/14* (2006.01)

(52) U.S. Cl.
CPC ..... *B41J 2/1623* (2013.01); *B41J 2/14209* (2013.01); *B41J 2/1609* (2013.01)

(58) Field of Classification Search
CPC ..... B41J 2002/14362; B41J 2202/08; B41J 2/14209; B41J 2/14274; B41J 2/1609; B41J 2/1623
See application file for complete search history.

(56) References Cited

U.S. PATENT DOCUMENTS 8,500,232 B2 * 8/2013 Suh ..... B41J 2/1408 347/18
2009/0051724 A1 * 2/2009 Katoh ..... B41J 2/145 347/18
2010/0328409 A1 12/2010 Matsufuji et al.
2013/0038651 A1 2/2013 Satou et al.
2014/0191062 A1 * 7/2014 Sasagawa ..... B41J 2/14209 239/75
2015/0077469 A1 3/2015 Kohda et al.
2017/0120585 A1 5/2017 Matsufuji
2017/0129245 A1 5/2017 Kohda et al.
2018/0290446 A1 10/2018 Kohda et al.
2019/0217607 A1 7/2019 Akiyama et al.

FOREIGN PATENT DOCUMENTS

JP 2006-007498 1/2006
JP 2006-181949 7/2006
JP 2009-132095 6/2009

(Continued)

*Primary Examiner* — Jannelle M Lebron
(74) *Attorney, Agent, or Firm* — Duft & Bornsen, PC

(57) ABSTRACT

A liquid discharge head includes a plurality of nozzles from which a liquid is discharged in a discharge direction, a plurality of individual chambers communicating with the plurality of nozzles, respectively, a common chamber communicating with each of the plurality of individual chambers, a drive element configured to change a volume of each of the plurality of individual chambers to discharge the liquid in the plurality of individual chambers from the plurality of nozzles, and a refrigerant channel through which a refrigerant flows, the refrigerant channel facing the common chamber via a partition in the discharge direction.

10 Claims, 8 Drawing Sheets

(56) References Cited

FOREIGN PATENT DOCUMENTS

| | | |
|---|---|---|
| JP | 2010-082900 | 4/2010 |
| JP | 2011-042155 | 3/2011 |
| JP | 2014-004718 | 1/2014 |
| JP | 2017-065041 | 4/2017 |
| JP | 2019-123115 | 7/2019 |

* cited by examiner

LIQUID DISCHARGE HEAD AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-223340, filed on Nov. 29, 2018, in the Japan Patent Office, the entire disclosure of which is incorporated by reference herein.

BACKGROUND

Technical Field

The present disclosure relates to a liquid discharge head and a liquid discharge apparatus.

Discussion of the Background Art

A liquid discharge head supplies liquid from a common chamber to a plurality of individual chambers communicating with a plurality of nozzles, respectively. The liquid discharge head drives a drive element to discharge the liquid inside the plurality of individual chambers from the plurality of nozzles.

For example, a liquid discharge head includes a refrigerant channel, through which refrigerant flows. The refrigerant channel is arranged adjacent to a common chamber on a side at which an individual chamber is arranged to cool both of the common chamber and the individual chamber.

SUMMARY

In an aspect of this disclosure, a liquid discharge head includes a plurality of nozzles from which a liquid is discharged in a discharge direction, a plurality of individual chambers communicating with the plurality of nozzles, respectively, a common chamber communicating with each of the plurality of individual chambers, a drive element configured to change a volume of each of the plurality of individual chambers to discharge the liquid in the plurality of individual chambers from the plurality of nozzles, and a refrigerant channel through which a refrigerant flows, the refrigerant channel facing the common chamber via a partition in the discharge direction.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
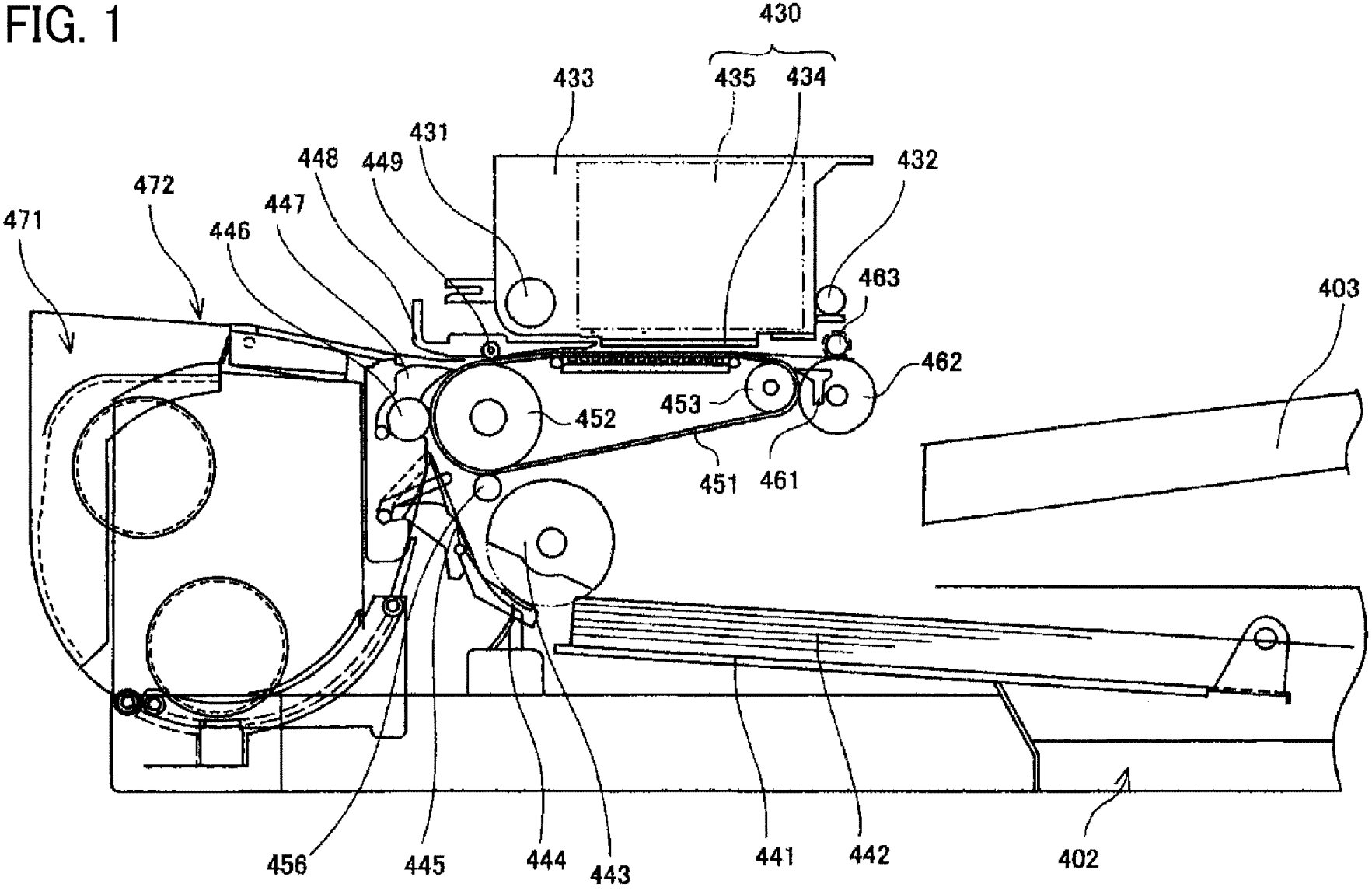
FIG. 1 is a main configuration view illustrating main components of an inkjet recording apparatus according to a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of the present disclosure is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of the present disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

First Embodiment

Hereinafter, an embodiment in which the present disclosure is applied to a liquid discharge head used in an inkjet recording apparatus serving as a liquid discharge apparatus is described below. Hereinafter, the present embodiment is referred to as "first embodiment".

Note that the present disclosure is not limited to the embodiments exemplified below.

Further, note that a recording material on which an image is recorded by the inkjet recording apparatus is not limited to paper, and includes an overhead projector (OHP) sheet, cloth, glass, a substrate, and the like, represents the material to which ink droplets, other kinds of liquid, and the like can adhere, and further includes materials referred to as a recording target medium, a recording medium, recording paper, a recording paper sheet, and the like. Further, note that any of "image forming", "recording", "character printing", "imprinting", and "printing" used herein may be used synonymously with each other.

The inkjet recording apparatus includes both of a serial type inkjet recording apparatus and a line type inkjet recording apparatus, unless otherwise particularly specified. The serial type inkjet recording apparatus moves a liquid discharge head mounted on a carriage in a main-scanning direction MSD orthogonal to a sheet feeding direction and performs recording. The line type inkjet recording apparatus uses a line type head in which a plurality of discharge ports (nozzles) that discharges droplets across a substantially entire width of a recording region is arranged. In the first embodiment, an example of adopting the serial type will be described, but the present disclosure is not limited to the serial type.

Types of the liquid discharge head are roughly divided into a few methods in accordance with a type of an actuator means used to discharge ink droplets (liquid). For example, there is a piezo method in which a part of a wall of a liquid chamber is formed as a thin diaphragm, and a piezoelectric element as an electromechanical conversion element is arranged corresponding the diaphragm, and deformation of the piezoelectric element caused by voltage application deforms the diaphragm.

Thus a pressure inside a pressure chamber is changed to discharge the ink droplets. Further, there is a method in which a heating body element is arranged inside a liquid chamber, bubbles are generated by heating a heating body by energization, and ink droplets are discharged by pressure of the bubbles. Further, there is an electrostatic type in which an electric field is formed between a diaphragm forming a wall surface of a liquid chamber and an individual electrode arranged outside the liquid chamber in a manner facing the diaphragm, the diaphragm is deformed by the electric field to change a pressure or volume inside the liquid chamber, thereby discharging ink droplets from a nozzle. In the first embodiment, an example of adopting the piezo method will be described, but the present disclosure is not limited to the piezo method.

First, a basic configuration of the inkjet recording apparatus according to the first embodiment will be described.

FIG. 1 is a main configuration view illustrating main components of the inkjet recording apparatus according to the first embodiment.

Figure 2:
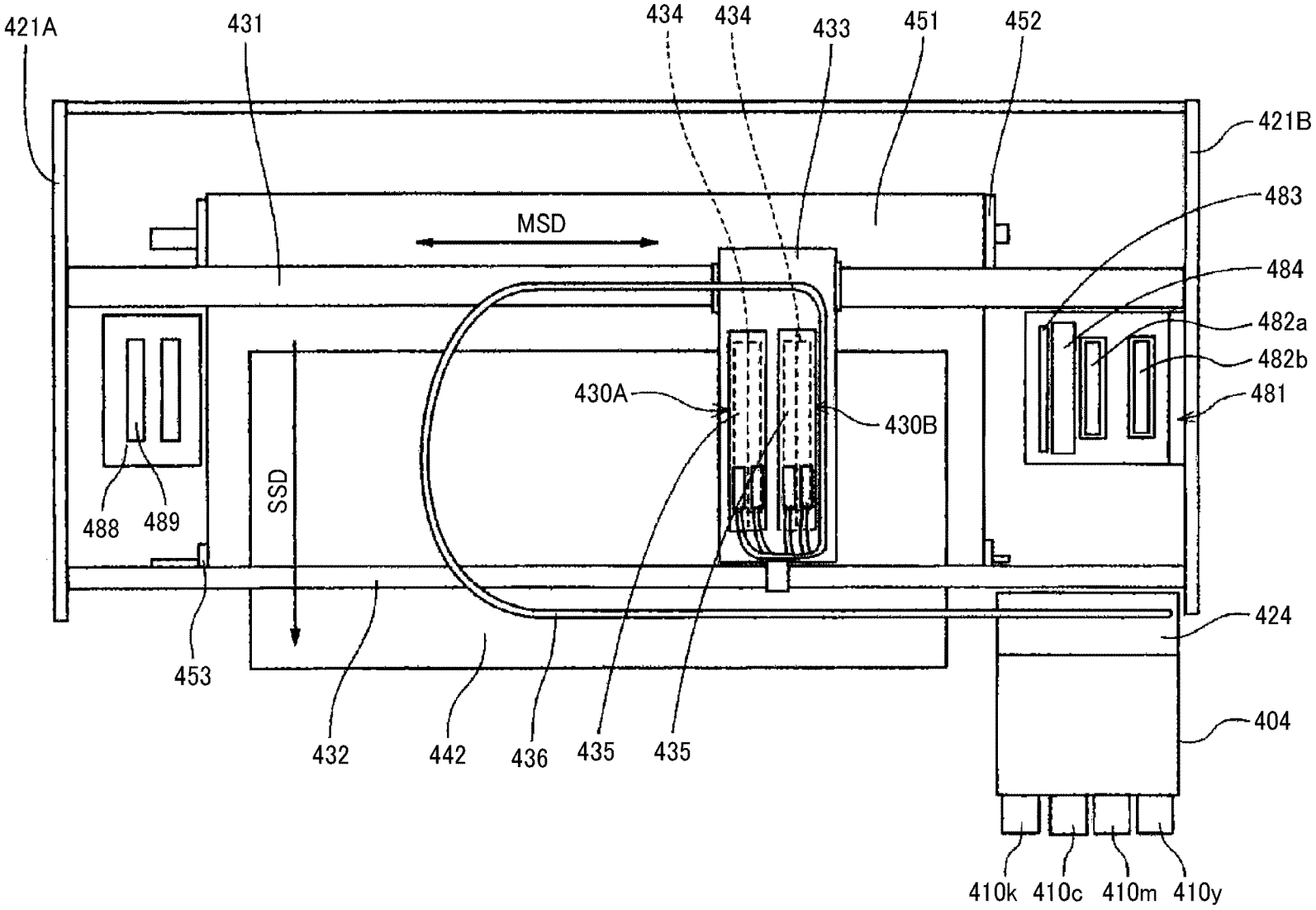
FIG. 2 is a plan view illustrating the main components.

FIG. 2 is a plan view illustrating the main components.

The inkjet recording apparatus according to the first embodiment is a serial type inkjet recording apparatus, in which a carriage 433 is held to reciprocally move in the main-scanning direction indicated by arrow MSD by main guide rod 431 and sub guide rods 432 laterally bridged between a left-side plate 421A and right-side plate 421B. The carriage 433 includes two liquid discharge devices 430A and 430B in each of which a liquid discharge head 434 as a liquid discharge member and a head tank 435 as a sub tank that supplies liquid ink to the liquid discharge head 434 are integrally mounted. The liquid discharge head 434 is attached while setting a liquid discharge direction indicated by arrow LDD in FIGS. 3 and 6. The liquid discharge direction LDD is oriented in a direction vertically downward in FIG. 6.

Figure 3:
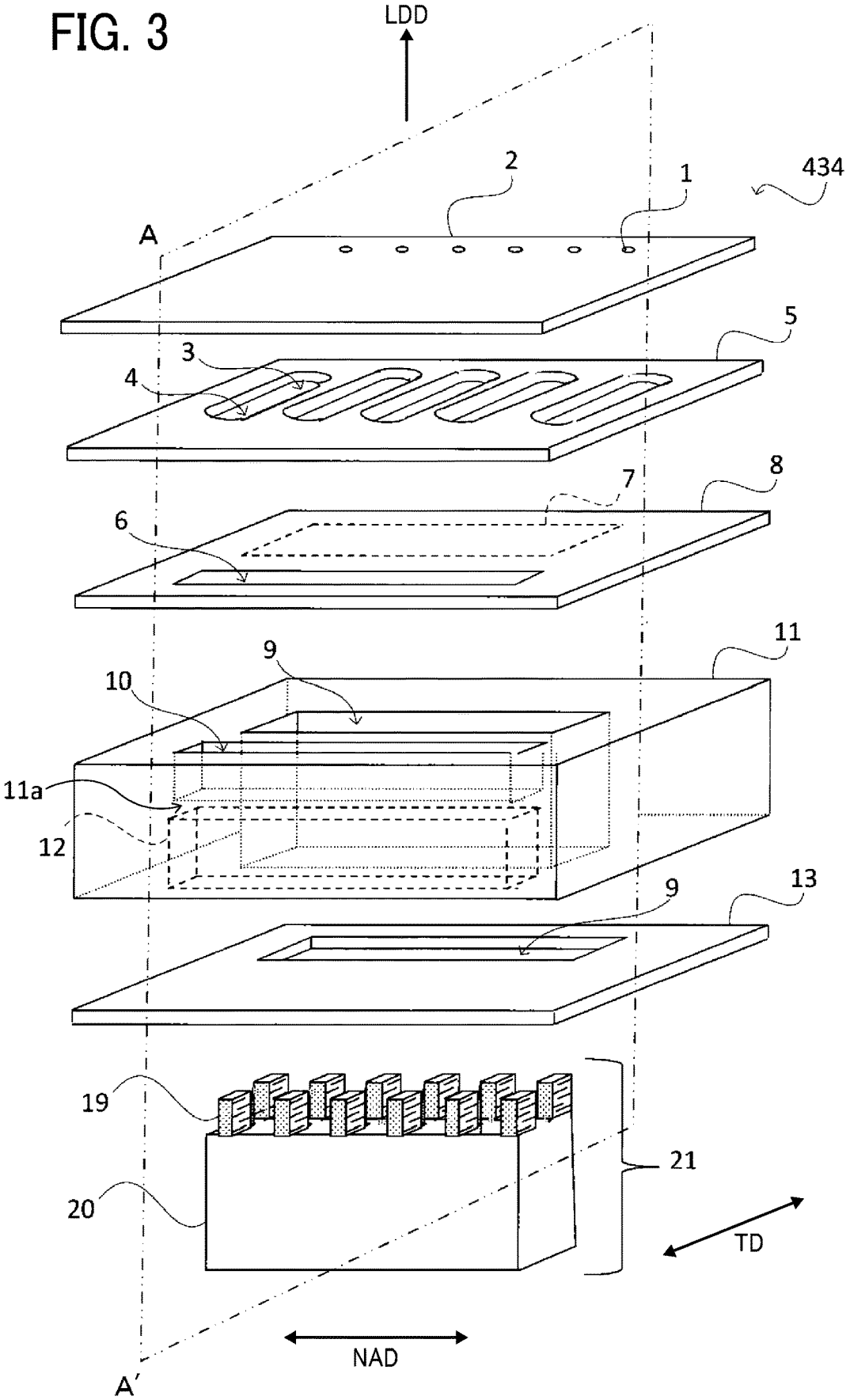
FIG. 3 is an exploded perspective view schematically illustrating a structure of a liquid discharge head in the inkjet recording apparatus.

A plurality of nozzles 1 is arrayed along a nozzle array direction indicated by arrow NAD in FIG. 3 that is a longitudinal direction of a nozzle array including a plurality of nozzles 1 (discharge holes). The nozzle array direction NAD is arranged parallel to a sub-scanning direction indicated by arrow SSD in FIG. 2 (longitudinal direction of the liquid discharge head 434) orthogonal to the main-scanning direction MSD.

The main-scanning direction is indicated by arrow MSD FIG. 2, and the sub-scanning direction is indicated by arrow SSD FIG. 2. The nozzle array direction is indicated by arrow NAD in FIG. 3.

Each of the two liquid discharge devices 430A and 430B has two nozzle arrays. The liquid discharge head 434 of one of the liquid discharge device 430A discharges ink droplets of black (K) from each of nozzles on one nozzle array, and discharges ink droplets of cyan (C) from each of nozzles in the other nozzle array. Further, the liquid discharge head 434 of the other liquid discharge device 430B discharges ink droplets of magenta (M) from each of nozzles in one nozzle array, and discharges ink droplets of yellow (Y) from each of nozzles in the other nozzle array.

Note that the inkjet recording apparatus according to the first embodiment uses two liquid discharge heads to discharge the ink droplets of the four colors. However, four nozzle arrays can be arranged in one liquid discharge head to discharge the four colors of ink from the one liquid discharge head. Further, the term "integration" in each of the liquid discharge devices 430A and 430B indicates that the liquid discharge head 434 and the head tank 435 are secured to each other directly or through fastening, bonding, or the like via a filter member. Otherwise, the term "integration" indicates that the liquid discharge head 434 and the head tank 435 are connected to each other by a tube or the like.

Main tanks 410*k*, 410*c*, 410*m*, and 410*y*, which are liquid cartridges of each colors of black, cyan, magenta, and yellow, are detachably attached to a cartridge holder 404 on an apparatus main body side. Hereinafter, the main tanks 410*k*, 410*c*, 410*m*, and 410*y* are collectively referred to as the "main tank 410".

Then, the ink of each color is fed from a main tank 410 of each color to the head tank 435 in each of the liquid discharge devices 430A and 430B via a supply tube 436 of each color by a liquid feeding device 424 including a liquid feeding pump 438*c*.

The inkjet recording apparatus according to the first embodiment includes a sheet feeder to feed recording sheets 442 as a recording material stacked on a sheet stacker 441 of a sheet feeding tray 402. The sheet feeder includes: a sheet feeding roller 443 that separates and feeds the recording sheets 442 one by one from the sheet stacker 441; a separate pad 444 facing the sheet feeding roller 443; and the like.

Further, the inkjet recording apparatus according to the first embodiment further includes: a guide 445 that conveys and guides the fed recording sheet 442; a counter roller 446; a conveyance guide 447; and a pressing member 448 including a leading end pressing roller 449. The inkjet recording apparatus further includes a conveyance belt 451 that is a conveyance means to attract and convey a conveyed recording sheet 442 at a position facing the liquid discharge head 434 of the liquid discharge device 430.

The conveyance belt 451 is an endless belt and passed around a conveyor roller 452 and a tension roller 453, and revolves in a belt conveyance direction (sub-scanning direction SSD). For the conveyance belt 451, an electrostatic conveyance belt charged by a charging roller 456 that is a charging means is used. However, for the conveyance belt 451, a conveyance belt that performs attraction by air suction may also be used. Also, for the conveyance means, a roller may be used to perform conveyance, instead of using the conveyance belt.

On a downstream side of the tension roller 453 around which the conveyance belt 451 is passed, provided are: a separation claw 461 to separate each recording sheet 442 from the conveyance belt 451; and a sheet ejection roller 462 and sheet ejection roller 463. Under the sheet ejection roller 462, a sheet ejection tray 403 is provided. Further, a duplex unit 471 is detachably attached to a back surface of the apparatus main body. The duplex unit 471 takes in and reverses the recording sheet 442 that has been returned by reverse rotation of the conveyance belt 451, and feeds the recording sheet again between the counter roller 446 and the conveyance belt 451. Also, the duplex unit 471 has an upper surface used as a manual paper feeding 472. Further, a non-printing region on one side in the scanning direction of the carriage 433 includes a maintenance mechanism 481 in order to maintain and recover states of the nozzles of the liquid discharge heads 434 in the liquid discharge devices 430A and 430B.

The maintenance mechanism 481 includes caps 482*a* and 482*b* to cap nozzle surfaces of the liquid discharge heads 434. The maintenance mechanism 481 also includes a blade member 483 to wipe the nozzle surfaces. The maintenance mechanism 481 further includes, for example, a dummy discharge receiver 484 that receives ink at the time of performing dummy discharge. The dummy discharge is performed to discharge the ink that does not contribute to image forming in order to discharge thickened ink. Another dummy discharge receiver 488 is also arranged in a non-printing region on the other side in the scanning direction of the carriage 433, and the dummy discharge receiver 488 receives the ink at the time of the dummy discharge during image forming or the like. The dummy discharge receiver 488 includes, for example, an opening 489 along the nozzle arrangement direction in each liquid discharge head 434.

In the inkjet recording apparatus according to the first embodiment, the recording sheets 442 are separated and fed one by one from the sheet feeding tray 402, and each recording sheet 442 fed in a direction substantially vertically upward is guided by the guide 445, and conveyed while being sandwiched between the conveyance belt 451 and the counter roller 446. Then, a leading end of the recording sheet 442 is guided by a conveyance guide 447 and pressed against the conveyance belt 451 by the leading end pressing roller 449, and the conveyance direction of the recording sheet 442 is changed by approximately 90 degrees. Then, when the recording sheet 442 is fed onto the conveyance belt 451 electrically charged, the recording sheet 442 is attracted to the conveyance belt 451, and the recording sheet 442 is conveyed in the sub-scanning direction SSD by the revolving movement of the conveyance belt 451. Then, the liquid discharge head 434 in each of the liquid discharge device 430A and 430B is driven in accordance with an image signal while the carriage 433 is moved. Consequently, the ink is discharged toward the recording sheet 442 that is stopped to record an image of one line. Subsequently, the recording sheet 442 is conveyed by a predetermined amount, and then an image of a next line is formed. When a recording termination signal or a signal indicating that a tail end of the recording sheet 442 has reached a recording region is received, the recording operation is terminated, and the recording sheet 442 is ejected to the sheet ejection tray 403.

FIG. 3 is an exploded perspective view schematically illustrating a structure of each liquid discharge head 434.

Figure 4:
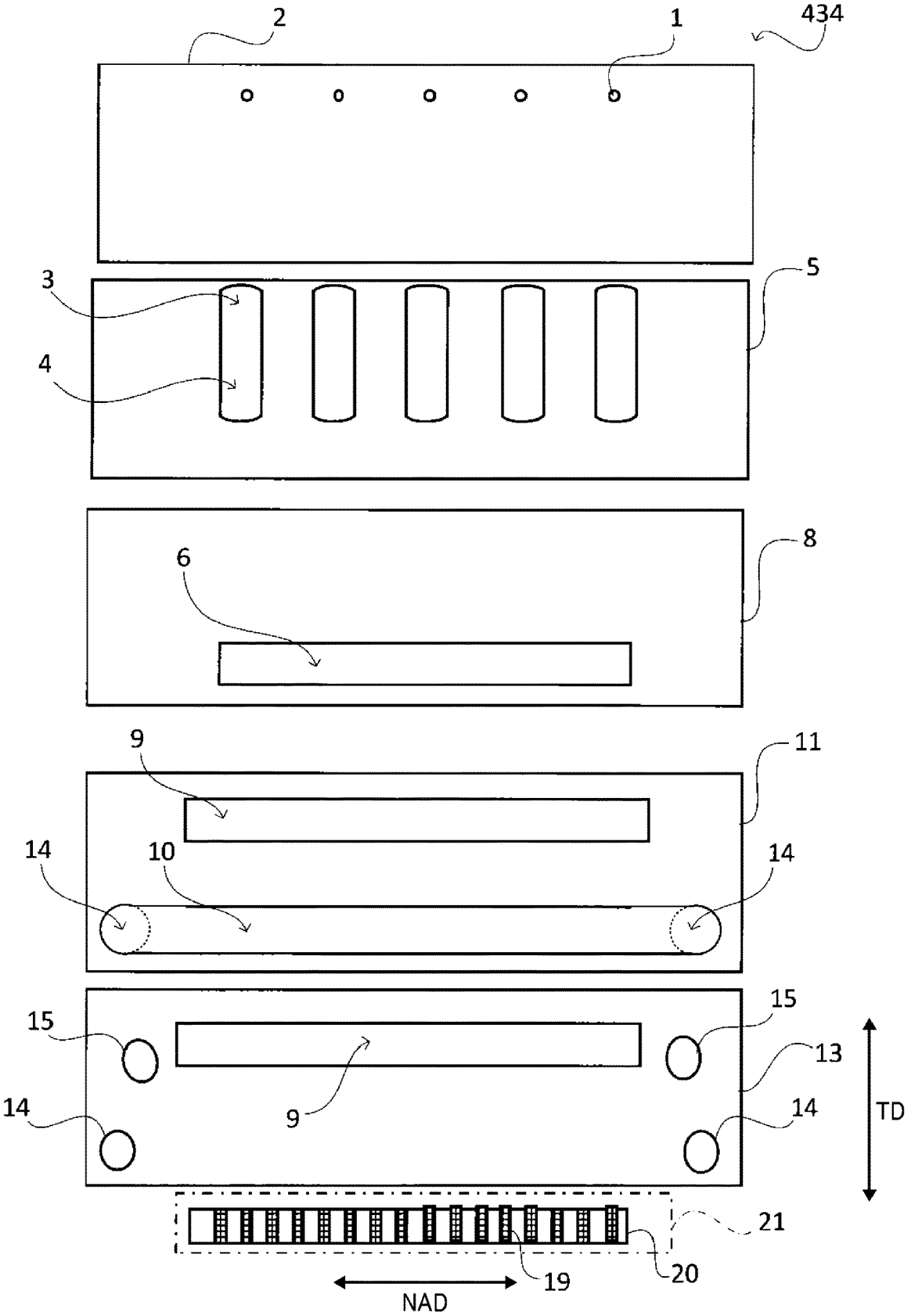
FIG. 4 is an exploded plan view illustrating each of plate-like members of the liquid discharge head from a nozzle side.

FIG. 4 is an exploded plan view illustrating each of plate-like members of the liquid discharge head 434 from a nozzle side.

Figure 5:
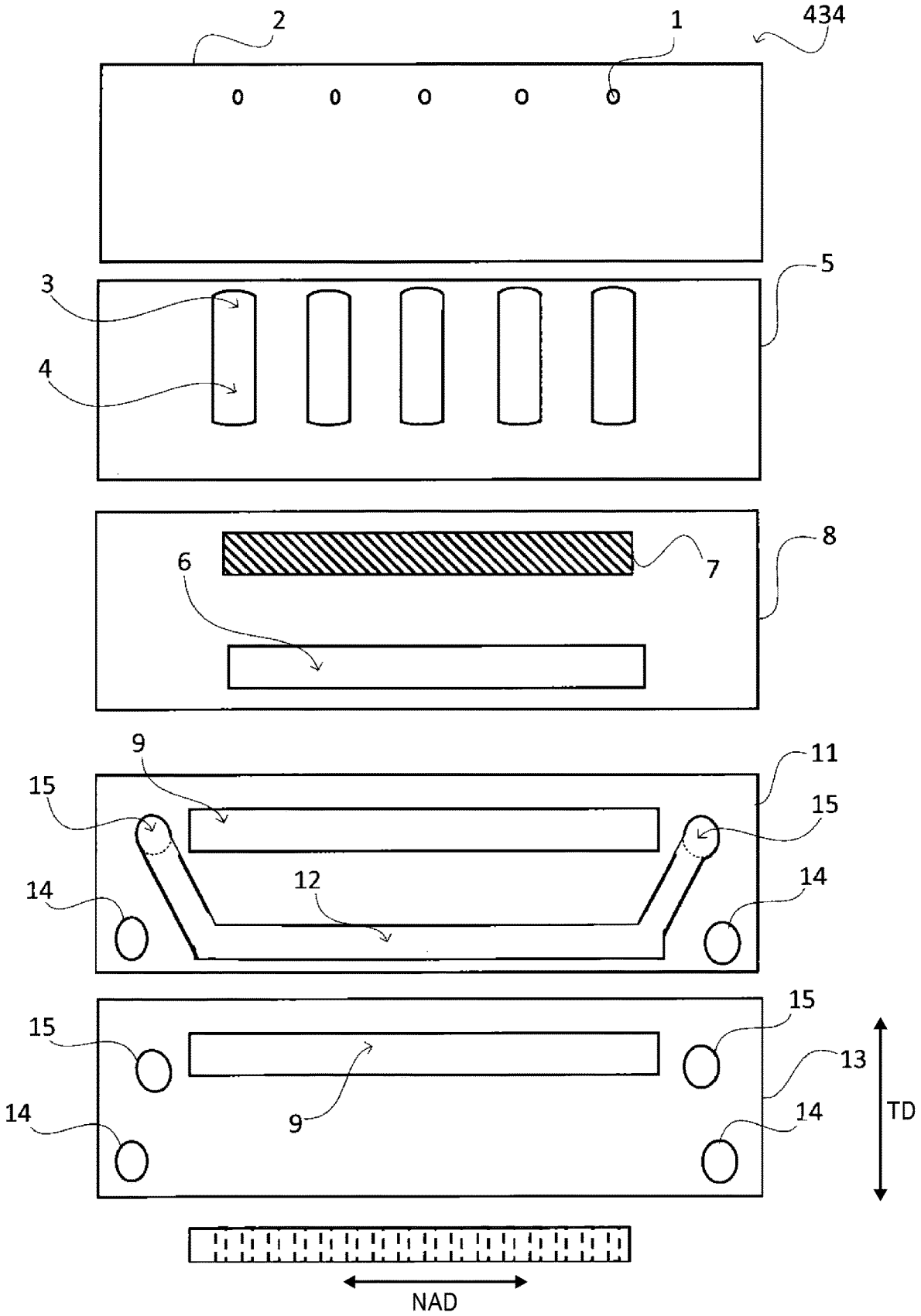
FIG. 5 is an exploded plan view illustrating each of the plate-like members of the liquid discharge head from a side of laminated piezoelectric elements.

FIG. 5 is an exploded plan view illustrating each of the plate-like members of the liquid discharge head 434 from a side of laminated piezoelectric elements.

Figure 6:
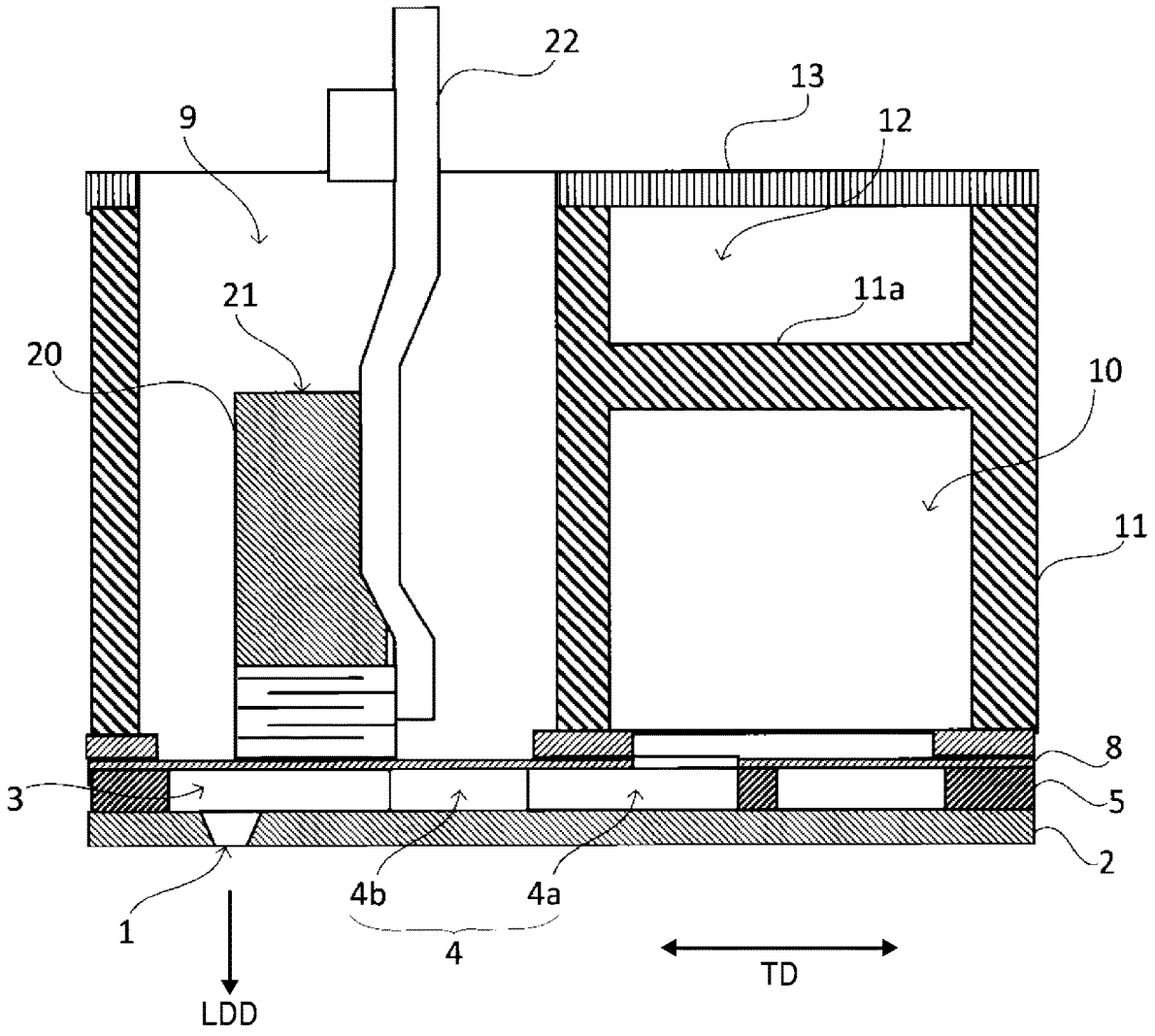
FIG. 6 is a cross-sectional view illustrating a cross section A-A' of the liquid discharge head in FIG. 3.

FIG. 6 is a cross-sectional view illustrating a cross section A-A' of the liquid discharge head 434 in FIG. 3.

Note that FIGS. 3 to 6 illustrate one of the two nozzle arrays provided in each liquid discharge head 434.

In these drawings, a plurality of nozzles 1 as discharge holes is formed on a nozzle plate 2 as a discharge hole forming member, and the nozzle plate 2 includes a stainless-steel plate. Processing accuracy of a slit (through hole) to be a nozzle 1 seriously affects ink discharge characteristics of the liquid discharge head 434. To suppress non-uniform dimensional accuracy among the plurality of nozzles 1, it may be necessary to process the plurality of slits of the nozzle plate 2 with high accuracy. Thus, the plurality of slits of the nozzle plate 2 is formed by a pressing method, a laser processing method, a nickel electroforming method, or the like.

Pressure chambers 3 functioning as a plurality of individual chambers, and a plurality of individual chambers 4 individually communicating with the pressure chambers 3 have side surfaces formed by the slits provided on a channel plate 5. Each of the plurality of individual chambers 4 provides individual communication between a common chamber 10 and each of the plurality of pressure chambers 3 described later, and has a large diameter portion 4*a* (see FIG. 6) having a relatively large size in a plate surface direction and a small diameter portion 4*b* (see FIG. 6) having a diameter smaller than a diameter of the large diameter portion 4*a*. Then, an ink flow amount from the common chamber 10 into each pressure chamber 3 is controlled by channel resistance in the small diameter portion 4*b*.

Each of the plurality of pressure chambers 3 communicates with one of the plurality of nozzles 1 provided in the nozzle plate 2. The slits provided in the channel plate 5 are manufactured by a precision pressing method, and the slits function as individual chamber forming members and individual chamber forming members in order to form the individual chambers 4 and the pressure chambers 3.

A diaphragm plate 8 includes, for example, a diaphragm film 7 used to efficiently transmit displacement of a piezoelectric actuator 21 to the pressure chamber 3, and an individual supply opening 6 located at a boundary between the common chamber 10 and the plurality of individual chamber 4. The diaphragm film 7 includes a solid region out of a base material plate of the diaphragm plate 8 and has a thickness same as the thickness of the base material plate. In the diaphragm plate 8, a portion thicker than the diaphragm film 7 includes: the base material plate; and a portion electrodeposited by electroforming the base material plate. The individual supply opening 6 is a through opening providing communication between the inside of each individual chamber 4 and the inside of the common chamber 10.

A frame 11 as a common chamber forming member includes a large rectangular through opening in order to constitute an actuator inserting portion 9 used to insert the piezoelectric actuator 21 described later. Further, a large rectangular opening to form the common chamber 10 is also formed. Further, a large rectangular opening to form a refrigerant channel 12 serving as a temperature-adjustment channel is also formed on a side of the frame 11 opposite to a side where the common chamber 10 is opened.

Hereinafter, the "temperature-adjustment channel" is also referred to as the "refrigerant channel 12".

The refrigerant channel 12 is formed adjacent to the common chamber 10, and is located, with respect to the common chamber 10, on an opposite side of the channel plate 5 where the pressure chambers 3 are formed. In the first embodiment, the refrigerant channel 12 is arranged on a side vertically above the common chamber 10.

A partition plate 13 is used to seal the refrigerant channel 12 while covering the opening of the refrigerant channel 12 of the frame 11. The partition plate 13 includes a through hole forming an ink introduction channel 14 used to: guide the ink that has been fed from the head tank 435 to the common chamber 10; and discharge the ink that has passed through the inside of the common chamber 10 from the common chamber 10. The partition plate 13 further includes a through hole forming a temperature-adjustment liquid introduction channel 15 used to introduce the temperature-adjustment liquid to the refrigerant channel 12 and discharge the refrigerant channel 12 from the refrigerant channel 12. The refrigerant is one example of the temperature-adjustment liquid. As a method of forming the through openings and the through holes, cutting work or the like can be exemplified.

The rectangular through opening to constitute the actuator inserting portion 9 is formed so as to accommodate the entire piezoelectric actuators 21, but a plurality of partition walls may also be provided so as to individually accommodate a plurality of piezoelectric elements 19 of the piezoelectric actuator 21 to enhance rigidity. Enhancement of the rigidity can reduce malfunction caused by a mechanical factor of cross talk (mutual interference between channels (combination of the nozzles 1, the pressure chambers 3, the individual chambers 4, and the piezoelectric elements 19)).

The piezoelectric actuator 21 includes: the plurality of piezoelectric elements 19 corresponding to the plurality of nozzles 1, respectively; and a fixing base 20 that fixes the piezoelectric elements 19 in the liquid discharge head 434. One end surface of each piezoelectric element 19 is fixed to one end surface of the fixing base 20 using an adhesive bond, and the other end surface of the piezoelectric element 19 is joined to the diaphragm film 7. Each piezoelectric element 19 is connected to: an individual electrode individually provided per the piezoelectric element; and a common electrode common among the piezoelectric elements. The individual electrodes are connected to individual switching elements used to individually control turning on and turning off of the power.

The switching elements are disposed on a flexible printed-circuit board 22. According to such an electrode structure, each of the plurality of piezoelectric elements 19 can be individually driven (displaced), and an ink pressure inside each of the plurality of pressure chambers 3 can be individually controlled by individually driving the piezoelectric elements. Ink droplets are discharged from each nozzle 1 communicating with each pressure chamber 3 in which the ink pressure is raised by the displacement of the piezoelectric element 19.

FIG. 6 is a cross-sectional view of the liquid discharge head 434 along a line A-A' in FIG. 3. FIGS. 4 and 5 are plan views of each components (plates) constituting the liquid discharge head 434 as illustrated in FIG. 3.

The ink introduced from the head tank 435 flows into the common chamber 10 through the ink introduction channel 14. The common chamber 10 is connected, through the individual supply opening 6, to each large diameter portions 4*a* of the individual chambers 4 in each channel. The ink that has entered the large diameter portion 4*a* of the individual chamber 4 from the common chamber 10 enters the small diameter portion 4*b* and flows toward the pressure chamber 3 while being applied with the channel resistance.

Next, ink cooling in the liquid discharge head 434 according to the first embodiment will be described.

In the liquid discharge head 434 of the first embodiment, the piezoelectric elements 19 generate heat because the piezoelectric actuator 21 is driven in order to discharge the ink. The generated heat heats, via the head structure body (such as the frame 11) constituting the liquid discharge head 434, the ink to be discharged. To discharge the ink at a higher speed, it may be necessary to generate vibration of the piezoelectric actuator 21 at a high frequency.

In the above-described case, heat is specially generated to change a temperature of the ink. The temperature of the ink is also changed by a change in an environmental temperature. Such a temperature change causes changes in ink viscosity, surface tension, and the like. Therefore, a discharge speed, discharge volume (discharge amount), and the like of the ink are changed, which adversely affects recording quality. Note that such a disadvantage is not limited to the piezo method like the first embodiment, but also occurs in the method using a heating body element or the electrostatic method.

Generally, in the liquid discharge head, directly radiating the heat of the heated ink is effective among technologies by which heat generated by head driving is radiated and a temperature is adjusted. The reason is that an ink temperature change caused by a change in a so-called environmental temperature cannot be coped with by a structure that cools: a drive element to be a heat generation source; and a drive circuit substrate of the drive element. As a structure that directly radiates the heat of the heated ink, cooling each of the pressure chambers 3 can be considered, but cooling the common chamber 10 can more effectively cool the ink.

A refrigerant channel (corresponding to the refrigerant channel 12 of the first embodiment) where the refrigerant is made to flow is arranged adjacent to the common chamber 10 on a side where the pressure chambers 3 are located.

However, in the above-described case, the plurality of individual chambers 4 providing communication between the common chamber 10 and each of the pressure chambers 3 exists inside the refrigerant channel. When such a plurality of individual chambers 4 exists inside the refrigerant channel, it may be necessary to broaden an interval between the individual chambers 4 in order to ensure a flow of the refrigerant. Thus, it may also be necessary to broaden an interval between the pressure chambers 3. As a result, the interval between the nozzles 1 communicating with the pressure chambers 3 may also be needed to be broadened. Consequently, an image resolution is deteriorated, and Further, the liquid discharge head 434 is upsized.

Accordingly, in the first embodiment, as illustrated in FIG. 6, the refrigerant channel 12 functioning as the refrigerant channel is arranged adjacent to the common chamber 10 on an opposite side in the liquid discharge direction (vertical direction in FIG. 6) of a side where the pressure chambers 3 are located. As a result, the individual chambers 4 providing communication between the common chamber 10 and each of the pressure chambers 3 do not exist in the refrigerant channel 12, and there is no need to broaden the interval between the individual chambers 4 (interval in the nozzle array direction NAD, namely, a direction perpendicular to the sheet surface of FIG. 6) in order to ensure the flow of the refrigerant. Also, since there is no need to broaden the interval between the pressure chambers 3, the interval between the nozzles 1 can be kept narrow.

Further, the liquid discharge head 434 of the first embodiment includes the two nozzle arrays, and the interval between these nozzle arrays can be kept narrow based on the similar reason. Since the interval (array pitch) between the nozzle arrays is kept narrow, a landing position error between the nozzle arrays caused by non-uniform moving speed of the liquid discharge head 434 can be reduced, and recording of an image having higher quality is achieved.

Further, since no refrigerant channel 12 is provided between the common chamber 10 and the pressure chambers 3 or between the common chamber 10 and the individual chambers 4, there is no need to provide a space for the refrigerant channel 12 between the channel plate 5 forming the pressure chambers 3 and the diaphragm plate 8 joined to the channel plate 5, and a broad joined surface can be ensured. As a result, rigidity of the channel plate 5 forming the pressure chambers 3 can be ensured, and malfunction caused by the mechanical factor of the crosstalk can be reduced.

Here, the heat generated by the piezoelectric elements 19 is transmitted from the pressure chambers 3 and the individual chambers 4 to the common chamber 10 to heat the ink inside the common chamber 10. As for heat distribution of the entire ink inside the liquid discharge head 434, the ink temperature tends to be higher in a place vertically above the common chamber 10 due to generation of heat convection. The liquid discharge head 434 of the first embodiment is attached such that the nozzle plate 2 faces vertically downward, and the liquid discharge direction is oriented vertically downward. Therefore, the refrigerant channel 12 of the first embodiment is arranged vertically above the common chamber 10. Therefore, according to the first embodiment, the heat at a portion vertically above the common chamber 10 can be subjected to heat exchange with the refrigerant contained inside the refrigerant channel 12, and the liquid discharge head 434 having excellent cooling efficiency can be achieved.

Thus, a liquid discharge head 434 includes a plurality of nozzles 1 from which a liquid is discharged in a discharge direction LDD, a plurality of individual chambers 4 communicating with the plurality of nozzles 1, respectively, a common chamber 10 communicating with each of the plurality of individual chambers 4, a drive element 19 to change a volume of each of the plurality of individual chambers 4 to discharge the liquid in the plurality of individual chambers 4 from the plurality of nozzles 1, and a refrigerant channel 12 through which a refrigerant flows, the refrigerant channel 12 facing the common chamber 10 via a partition 11*a* in the discharge direction LDD.

The common chamber 10 is disposed between the refrigerant channel 12 and the plurality of individual chambers 4 in the discharge direction LDD. The refrigerant channel 12 is disposed above the common chamber 10 and the plurality of individual chambers 4 in the discharge direction LDD in which the liquid is discharged downward from the plurality of nozzles 1.

The liquid discharge head 434 further includes a frame 11 in which the common chamber 10 and the refrigerant channel 12 are formed. The common chamber 10 is formed on a first surface (upper surface in FIG. 3) of the frame 11, and the refrigerant channel 12 is formed on a second surface (lower surface in FIG. 3) of the frame 11 opposite the first surface. The refrigerant channel 12 faces the common chamber 10 via the partition 11*a* in the discharge direction LDD.

The liquid discharge head 434 further includes a diaphragm plate 8 on the frame 11, the plurality of individual chambers 4 facing a first surface (upper surface in FIG. 3) of the diaphragm plate 8, and the drive element 19 contacting with a second surface (lower surface in FIG. 3) of the diaphragm plate 8 opposite the first surface of the diaphragm plate 8. The common chamber 10 is arranged between the refrigerant channel 12 and the second surface of the diaphragm plate 8 in the discharge direction LDD.

Further, a longitudinal direction of the refrigerant channel 12 is parallel to a nozzle array direction NAD in which the plurality of nozzles 1 are arrayed, and the refrigerant channel 12 covers a region in which the common chamber 10 and the plurality of individual chambers 4 are arranged in the nozzle array direction NAD.

Second Embodiment

Next, another embodiment in which the present disclosure is applied to a liquid discharge head used in an inkjet recording apparatus that is a liquid discharge apparatus is described below. Hereinafter, the following embodiment is also referred to as "second embodiment".

The inkjet recording apparatus of the second embodiment includes four nozzle arrays in one liquid discharge head, and discharges ink of the same color from all of the nozzle arrays. However, since a basic structure and operation of the inkjet recording apparatus of the second embodiment are similar to the basic structure and operation in a first embodiment described above, a description hereunder will be mainly provided on a cooling structure of the liquid discharge head.

Figure 7:
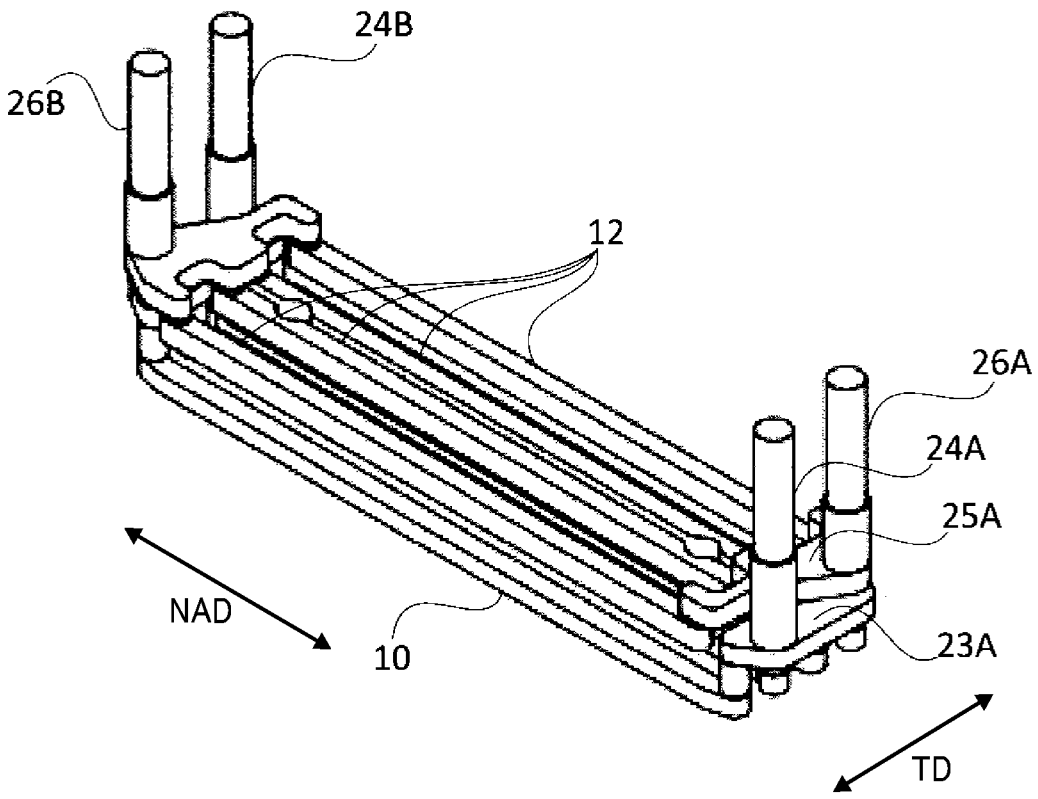
FIG. 7 is an explanatory view illustrating a positional relation between a common chamber and a refrigerant channel of a liquid discharge head according to a second embodiment.

FIG. 7 is an explanatory view illustrating a positional relation between a common chamber 10 and a refrigerant channel 12 of a liquid discharge head 434 according to the second embodiment. The refrigerant channel 12 is also referred to as the "refrigerant channel".

Figure 8:
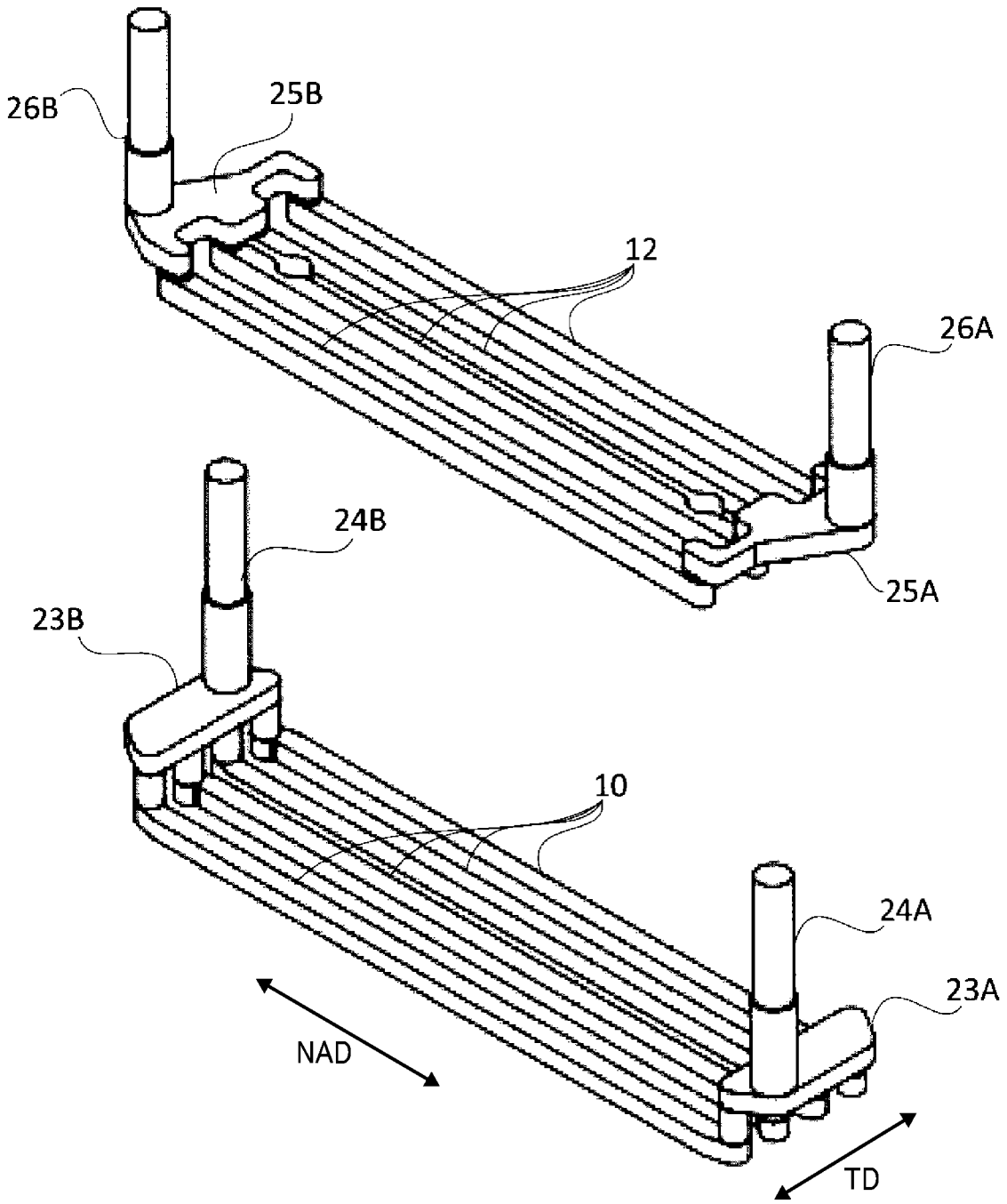
FIG. 8 is an explanatory view illustrating the common chamber and the refrigerant channel in a separated manner.

FIG. 8 is an explanatory view illustrating the common chamber 10 and the refrigerant channel 12 in a separated manner.

As described above, the liquid discharge head 434 mounted on the inkjet recording apparatus of the second embodiment includes four nozzle arrays, and one common chamber 10 is provided per nozzle array. In the second embodiment, since the ink of the same color is discharged from all of the four nozzle arrays, the ink of the same color is supplied to totally the four common chambers 10 connected to each of the nozzle arrays.

In the second embodiment, the four common chambers 10 communicate with each other via a liquid connection channel 23A at one end in a nozzle array direction NAD of the common chambers 10. The liquid connection channel 23A is connected to a liquid port 24A connected to a head tank 435.

Further, the four common chambers 10 also communicate with each other via a liquid connection channel 23B at another end in the nozzle array direction NAD of the common chambers 10.

The liquid connection channel 23B is connected to a liquid port 24B used to discharge the ink from the common chambers 10.

Further, in the second embodiment, refrigerant channels 12 that are four refrigerant channels are arranged corresponding to the four common chambers 10 respectively. Each of the refrigerant channels 12 communicates with each other via a refrigerant connection channel 25A at one end in the nozzle array direction NAD of the refrigerant channels 12. The refrigerant connection channel 25A is connected to a refrigerant port 26A connected to a refrigerant supply source.

Further, the four refrigerant channels 12 also communicate with each other via a refrigerant connection channel 25B at anther end in the nozzle array direction NAD of the refrigerant channel 12. The refrigerant connection channel 25B is connected to a refrigerant port 26B used to discharge the refrigerant (temperature-adjustment liquid) from the refrigerant channels 12.

In the second embodiment also, the four refrigerant channels 12 are arranged adjacent to the four common chambers 10, respectively, on an opposite side in a liquid discharge direction indicated by arrow LDD (vertical direction in FIG. 7) at which the pressure chambers 3 are located. Therefore, effects similar to the effects of the above-described first embodiment are exerted, and for example, an interval between the nozzles 1 can be kept narrow.

Further, the four refrigerant channels 12 of the second embodiment are also arranged vertically above the four common chambers 10, respectively. Therefore, in the second embodiment also, heat at a portion vertically above each of the common chambers 10 can be subjected to heat exchange with the refrigerant contained inside the refrigerant channels 12, and similar to the above-described first embodiment, the liquid discharge head 434 having excellent cooling efficiency can be achieved.

Further, in the second embodiment, as illustrated in FIG. 7, the liquid ports 24A and 24B and the refrigerant ports 26A and 26B are arranged at positions different from each other.

Specifically, the liquid ports 24A and 24B are arranged close to one end of the liquid connection channels 23A and 23B in the transverse direction TD (main-scanning direction MSD) at each ends of the common chambers 10 in the nozzle array direction NAD (sub-scanning direction SSD).

The refrigerant ports 26A and 26B are arranged close to another end of the refrigerant connection channels 25A and 25B in the transverse direction TD (main-scanning direction MSD) at each ends of the refrigerant channels 12 in the nozzle array direction NAD (sub-scanning direction SSD).

With the above-described arrangement, the liquid ports 24A and 24B and the refrigerant ports 26A and 26B can be arranged at the same position in the nozzle array direction NAD (sub-scanning direction SSD) so that the size of the liquid discharge head 434 in the nozzle array direction NAD can be reduced.

In particular, in the present embodiment, the refrigerant ports 26A and 26B are arranged at diagonally crossing positions when viewed from vertically above (in a plane orthogonal to the discharge direction LDD, that is, in a plane constituted by the nozzle array direction NAD and the transverse direction TD).

As a result, length of the channels of the four refrigerant channels 12 from the refrigerant port 26A on an entrance side to the refrigerant port 26B on an exit side can be easily made substantially the same. Thus, the liquid discharge head 434 can make the fluid resistance in the four refrigerant channels 12 to be substantially the same so that the flow rates of the refrigerant (temperature-adjustment liquid) in each of the four refrigerant channels 12 becomes substantially the same. Thus, the liquid discharge head 434 can prevent nonuniform cooling of the liquid in each of the four common chambers 10.

Further, in the present embodiment, the liquid ports 24A and 24B are arranged diagonally when viewed from vertically above. As a result, length of the channels passing through each pf the four common chambers 10 from the liquid port 24A on an entrance side to the liquid port 24B on an exit side can be easily made substantially the same.

Thus, fluid resistance of the four common chambers 10 can be made substantially uniform to make the ink flow rates in each of four common chambers 10 uniform, and nonuniform cooling of the ink among the four common chambers 10 can be prevented.

Further, in the second embodiment, the liquid connection channels 23A and 23B connects the four common chambers 10 at each ends pf the four common chambers 10 to communicate with each other. Further, the refrigerant connection channels 25A and 25B connects the four refrigerant channels 12 at each ends of the four refrigerant channels 12 to communicate with each other. Thus, it becomes simple to control the channels.

As illustrated in FIGS. 7 and 8, the liquid discharge head 434 includes a plurality of nozzle arrays, each of which including the plurality of nozzles 1 arrayed in the nozzle array direction NAD, the plurality of nozzle arrays arranged in a transverse direction TD (see FIG. 7) orthogonal to the nozzle array direction NAD. The transverse direction is indicated by TD in FIGS. 3 to 8. The transverse direction TD is along a flow direction of the liquid that flows through the individual chamber 4. The liquid discharge head 434 further includes a plurality of common chambers 10 including the common chamber 10, the plurality of common chambers 10 corresponding to the plurality of nozzle arrays, respectively.

The liquid discharge head 434 further includes a plurality of refrigerant channels 12 including the refrigerant channel 12, the plurality of refrigerant channels 12 corresponding to the plurality of common chambers 10, respectively, liquid connection channels 23A and 23B arranged at both ends of the plurality of common chambers 10 in the nozzle array direction NAD, each of the liquid connection channels 23A and 23B to connect each end of the plurality of common chambers 10 in the nozzle array direction NAD, liquid ports 24A and 24B connected to the liquid connection channels 23A and 23B, respectively, refrigerant connection channels 25A and 25B arranged at both ends of the plurality of refrigerant channels 12 in the nozzle array direction NAD, the refrigerant connection channels 25A and 25B to connect each end of the plurality of refrigerant channels 12 in the nozzle array direction NAD, and refrigerant ports 26A and 26B connected to the refrigerant connection channels 25A and 25B, respectively.

The liquid ports 24A and 24B are arranged at different positions from the refrigerant ports 26A and 26B in the transverse direction TD at both ends of the plurality of common chambers 10 in the nozzle array direction.

Further, two of the liquid ports 24A and 24B are arranged symmetrically with two of the refrigerant ports 26A and 26B in a plane orthogonal to the discharge direction LDD. More specifically, two of the liquid ports 24A and 24B are arranged at diagonally crossing positions with two of the refrigerant ports 26A and 26B in the plane consisting of the transverse direction TD and the nozzle array direction NAD.

The term "liquid discharge apparatus" in the present specification is an apparatus that includes a liquid discharge head or a liquid discharge device, and drives the liquid discharge head to discharge liquid. The liquid discharge apparatus may include not only an apparatus capable of discharging liquid to a material to which the liquid can adhere but also an apparatus that discharges liquid toward gas or into liquid.

The "liquid discharge apparatus" may include devices to feed, convey, and eject the material to which liquid can adhere, and may further include a pretreatment apparatus, a post-treatment apparatus, and the like.

For example, the "liquid discharge apparatus" may include, for example, an inkjet recording apparatus to form an image on a paper sheet by discharging ink, or a three-dimensional fabrication apparatus to discharge fabrication liquid to a powder layer in which powder is formed in layers in order to form a three-dimensional fabrication object.

The "liquid discharge apparatus" is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material to which liquid can adhere" indicates, for example, a material or medium to which the liquid adheres at least temporarily, a material or medium to which the liquid adheres and is fixed, or a material or a medium which the liquid adheres to and which the liquid permeates. Examples of the "material to which liquid can adhere" include recording media such as a paper sheet, recording paper, and a recording paper sheet, and a recording target medium such as a film, cloth, or the like, an electronic component such as an electronic substrate or a piezoelectric element, and media such as a powder layer, an organ model, and a testing cell. The "material to which liquid can adhere" includes any material to which the liquid adheres, unless particularly limited.

The above-described "material to which the liquid can adhere" may be any material as long as the liquid can adhere at least temporarily, and examples of the material include paper, thread, a fiber, cloth, leather, metal, plastic, glass, wood, ceramics, architectural materials like wall paper and floor material, textiles for clothing, and the like.

Further, the "liquid" may have any viscosity and surface tension at which the liquid can be discharged from the liquid discharge head, and is not particularly limited. However, preferably, the viscosity of the liquid is not greater than 30 mPa·s under an ordinary temperature and ordinary pressure or by heating or cooling. Examples of the liquid include solution, suspension, or emulsion containing, for example, a solvent such as water or an organic solvent, a colorant such as dye or pigment, a functional material such as a polymerizable compound, a resin, or a surfactant, a biocompatible material such as deoxyribonucleic acid (DNA), amino acid, protein, or calcium, or an edible material such as a natural colorant. Such solution, suspension, or emulsion can be used for, e.g., inkjet ink, surface treatment liquid, liquid used to form constituent elements of an electronic element or a light-emitting element, or a resist pattern of an electronic circuit, or material solution for three-dimensional fabrication. Specifically, the "liquid" includes ink, treatment liquid, a DNA sample, resist, a pattern material, binder, fabrication liquid, or solution and dispersion containing an amino acid, protein, and calcium.

Further, the "liquid discharge apparatus" may be an apparatus to relatively move the liquid discharge head and a material to which the liquid can adhere. However, the liquid discharge apparatus is not limited to such an apparatus. For example, the "liquid discharge apparatus" may be a serial type apparatus that moves the liquid discharge head, a line type apparatus that does not move the liquid discharge head, or the like.

Examples of the "liquid discharge apparatus" further include a treatment liquid coating apparatus to discharge the treatment liquid to a paper sheet to coat a surface of the paper sheet with treatment liquid to reform the surface of the paper sheet, an injection granulation apparatus in which composition liquid including raw materials dispersed in solution is sprayed through nozzles to granulate fine particles of the raw materials.

The "liquid discharge device" includes an assembly of parts relating to liquid discharge, and represents a structure including the liquid discharge head and a functional part(s) and a mechanism(s) integrated with the liquid discharge head. For example, the "liquid discharge device" includes a combination of the liquid discharge head with at least one of components including a head tank, a carriage, a supply mechanism, a maintenance mechanism, and a main scan moving unit.

Examples of the integrated unit include: a combination in which, for example, a liquid discharge head and one or more of functional parts/mechanisms are secured to each other through, e.g., fastening, bonding, or engaging; and a combination in which one of the liquid discharge head and the functional parts/the mechanisms is movably held by another. Further, the liquid discharge head, the functional parts, and the mechanisms may be detachable from each other.

For example, as described in the first and second embodiments, the liquid discharge device include the liquid discharge devices 430A and 430B in each of which the liquid discharge head 434 and the head tank 435 are integrated. Further, the liquid discharge device includes a device in which the liquid discharge head and the carriage are integrated. Further, the liquid discharge device includes a device in which the liquid discharge head is movably held by a guide member constituting a part of a scan moving unit to integrate the liquid discharge head and the main scan moving unit. Further, the liquid discharge device includes a device in which the liquid discharge head, the carriage, and the main scan moving unit are integrated.

Further, the liquid discharge device includes a device in which a cap member constituting a part of the maintenance mechanism is secured to the carriage to which the liquid discharge head is attached to integrate the liquid discharge head, the carriage, and the maintenance mechanism. Moreover, the liquid discharge device includes a device in which a tube is connected to the liquid discharge head to which a head tank or a channel part is installed to integrate the liquid discharge head and the supply mechanism. The main scan moving unit also includes a single guide member. The supply mechanism also includes a single tube or a single loading device.

The terms such as "image forming", "recording", "character printing", "imprinting", "printing", and "fabrication" used herein may be used synonymously with each other.

Note that the matters described above are examples and each of the following aspects exerts particular effects.

[First Aspect]

A first aspect is characterized in providing a liquid discharge head 434 that supplies liquid (e.g., ink) from a common chamber 10 to individual chambers (e.g., pressure chambers 3) communicating with a plurality of nozzles 1 respectively, and drives a drive element (e.g., piezoelectric element 19) to discharge, from each of the nozzles, the liquid inside each of the individual chambers, and further characterized in that a refrigerant channel (e.g., refrigerant channel 12) in which refrigerant (e.g., temperature-adjustment liquid) flows is arranged adjacent to the common chamber on an opposite side of a side where the individual chambers are located.

In the structure in which the refrigerant channel 12 is arranged adjacent to the common chamber 10 on a side at which the pressure chambers 3 are disposed, there is a plurality of individual chambers 4 that connect the common chamber 10 and the pressure chambers 3. When the plurality of individual chambers 4 exists inside the refrigerant channel 12, an interval between the individual chambers 4 may necessary be broadened to ensure flow of the refrigerant.

Thus, it may also be necessary to broaden an interval between the individual chambers 4. As a result, it may be necessary to broaden an interval between the nozzles communicating with the pressure chambers 3.

According to the present aspect, since the refrigerant channel 12 is arranged adjacent to and above the common chamber 10 on the opposite side of the pressure chambers 3, the individual chambers 4 that connect the common chamber 10 and the individual pressure chambers 3 are not necessary to exist inside the refrigerant channel 12.

Thus, it may not be necessary to broaden the interval between the individual chambers 4 to ensure the flow of the refrigerant, and it may also not be necessary to broaden the interval between the pressure chambers 3. Therefore, the interval between the nozzles 1 can be kept narrow.

[Second Aspect]

A second aspect is characterized in that the refrigerant channel is arranged vertically above the common chamber in the first aspect.

According to the present aspect, heat at a portion vertically above the common chamber in which a liquid temperature tends to rise can be subjected to heat exchange with the refrigerant inside the refrigerant channel, and a liquid discharge head having excellent cooling efficiency can be achieved.

[Third Aspect]

A third aspect is characterized in that a refrigerant channel member (e.g., frame 11) forming the refrigerant channel does not protrude to the outside of a common chamber member (e.g., frame 11) forming the common chamber in at least one of a direction parallel to a nozzle array direction NAD of the plurality of nozzles (e.g., sub-scanning direction SSD) and a direction orthogonal to the nozzle array direction NAD (e.g., main-scanning direction MSD) in the first aspect or the second aspect.

According to the present aspect, the liquid discharge head including the refrigerant channel can be downsized.

[Fourth Aspect]

A fourth aspect is characterized, in any one of the first aspect to the third aspect, in that a plurality of nozzle arrays each having the plurality of nozzles arrayed is arranged in a direction orthogonal to the nozzle array direction NAD of the plurality of nozzles, a plurality of the common chambers each provided per nozzle array or per two or more of the nozzle arrays is arranged, a plurality of the refrigerant channels is arranged corresponding to the plurality of common chambers, the plurality of common chambers communicates with each other and has liquid ports (e.g., liquid ports 24A and 24B) connected at both ends in the nozzle array direction NAD, and the plurality of refrigerant channels communicates with each other and has refrigerant ports (e.g., refrigerant ports 26A and 26B) connected at both ends in the nozzle array direction NAD. The liquid ports and the refrigerant ports are arranged at positions different from each other.

According to the present aspect, the liquid ports and the refrigerant ports can be arranged at the same position in the nozzle array direction NAD, and size increase in the nozzle array direction NAD can be suppressed.

[Fifth Aspect]

The liquid discharge head 434 according to a fifth aspect includes the two liquid ports 24A and 24B provided at each ends of the liquid communication channels 23A and 23B in the transverse direction TD on each ends of the common channel 10 in the nozzle array direction NAD.

Two refrigerant ports are provided at each ends of the refrigerant communication channels 25A and 25B in the transverse direction TD on each ends of the refrigerant channels 12 in the nozzle array direction NAD.

According to the present aspect, the liquid ports 24A and 24B and the refrigerant ports 25A and 25B are arranged at so-called diagonally crossing positions with respect to the plurality of common chambers 10 and the plurality of refrigerant channels 12. As a result, channel lengths are substantially made same among the plurality of common chambers 10 and among the plurality of refrigerant channels 12. Thus, fluid resistance can be substantially made uniform to make the flow rates uniform. As a result, nonuniform cooling of the ink among the four common chambers 10 can be prevented.

[Sixth Aspect]

A sixth aspect is characterized in using a liquid discharge head according to any one of the first aspect to the fifth aspect as the liquid discharge head in a liquid discharge apparatus (e.g., inkjet recording apparatus) including the liquid discharge head 434 that discharges liquid.

According to the present aspect, the liquid discharge apparatus having a narrow interval between nozzles can be achieved even though the refrigerant channels are provided.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles from which a liquid is discharged in a discharge direction;

a plurality of individual chambers communicating with the plurality of nozzles, respectively;

a common chamber communicating with each of the plurality of individual chambers;

a drive element configured to change a volume of each of the plurality of individual chambers to discharge the liquid in the plurality of individual chambers from the plurality of nozzles; and a refrigerant channel through which a refrigerant flows, the refrigerant channel facing the common chamber via a partition in the discharge direction.

2. The liquid discharge head according to claim 1, wherein the common chamber is disposed between the refrigerant channel and the plurality of individual chambers in the discharge direction.

3. The liquid discharge head according to claim 2, wherein the refrigerant channel is disposed above the common chamber and the plurality of individual chambers in the discharge direction in which the liquid is discharged downward from the plurality of nozzles.

4. The liquid discharge head according to claim 1, further comprising a frame in which the common chamber and the refrigerant channel are formed, wherein the common chamber is formed on a first surface of the frame, wherein the refrigerant channel is formed on a second surface of the frame opposite the first surface, and wherein the refrigerant channel faces the common chamber via the partition in the discharge direction.

5. The liquid discharge head according to claim 4, further comprising a diaphragm plate on the frame, wherein the plurality of individual chambers face a first surface of the diaphragm plate, wherein the drive element contacts a second surface of the diaphragm plate opposite the first surface of the diaphragm plate, wherein the common chamber is arranged between the refrigerant channel and the second surface of the diaphragm plate in the discharge direction.

6. The liquid discharge head according to claim 1, wherein a longitudinal direction of the refrigerant channel is parallel to a nozzle array direction in which the plurality of nozzles are arrayed, and the refrigerant channel covers a region in which the common chamber and the plurality of individual chambers are arranged in the nozzle array direction.

7. The liquid discharge head according to claim 6, further comprising:

a plurality of nozzle arrays, each of which includes the plurality of nozzles arrayed in the nozzle array direction, the plurality of nozzle arrays arranged in a transverse direction orthogonal to the nozzle array direction;

a plurality of common chambers including the common chamber, the plurality of common chambers corresponding to the plurality of nozzle arrays, respectively;

a plurality of refrigerant channels including the refrigerant channel, the plurality of refrigerant channels corresponding to the plurality of common chambers, respectively;

liquid connection channels arranged at both ends of the plurality of common chambers in the nozzle array direction, each of the liquid connection channels configured to connect each end of the plurality of common chambers in the nozzle array direction;

liquid ports connected to the liquid connection channels, respectively;

refrigerant connection channels arranged at both ends of the plurality of refrigerant channels in the nozzle array direction, each of the refrigerant connection channels configured to connect each end of the plurality of refrigerant channels in the nozzle array direction; and refrigerant ports connected to the refrigerant connection channels, respectively, wherein the liquid ports are arranged at different positions from the refrigerant ports in the transverse direction at both ends of the plurality of common chambers in the nozzle array direction.

8. The liquid discharge head according to claim 7, wherein two of the liquid ports are arranged symmetrically with two of the refrigerant ports in a plane orthogonal to the discharge direction.

9. The liquid discharge head according to claim 8, wherein two of the liquid ports are arranged at diagonally crossing positions with two of the refrigerant ports in the plane orthogonal to the discharge direction.

10. A liquid discharge apparatus comprising the liquid discharge head according to claim 1.

* * * * *